US007374430B2

(12) United States Patent
Nagawatari

(10) Patent No.: US 7,374,430 B2
(45) Date of Patent: May 20, 2008

(54) ELECTRICAL CONNECTOR FOR CONNECTING A FLAT-TYPE CIRCUIT BOARD

(75) Inventor: Takashi Nagawatari, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/706,287

(22) Filed: Feb. 15, 2007

(65) Prior Publication Data

US 2007/0197104 A1 Aug. 23, 2007

(30) Foreign Application Priority Data

Feb. 22, 2006 (JP) ..... 2006-044663

(51) Int. Cl.
*H01R 12/00* (2006.01)

(52) U.S. Cl. ..... 439/67

(58) Field of Classification Search ..... 439/67, 439/77, 493, 71

See application file for complete search history.

(56) References Cited

U.S. PATENT DOCUMENTS 4,023,877 A * 5/1977 Hennessey et al. ..... 439/329
4,023,878 A * 5/1977 Hennessey ..... 439/65
5,873,739 A * 2/1999 Roberts ..... 439/67

FOREIGN PATENT DOCUMENTS

JP 2004-227918 8/2004

* cited by examiner

*Primary Examiner*—Phuong K Dinh
(74) *Attorney, Agent, or Firm*—Kubotera & Associates, LLC

(57) ABSTRACT

An electrical connector for connecting a flat-type circuit board (1) includes a pressing member (3) to press the flat-type circuit board (1) to a member to be connected (P). The pressing member (3) includes a section to be supported by a support member (2); a bent section (6); a flat section (7); and a pressing section (8) having elasticity and facing the flat section, with the flat section (7) and the pressing section (8) being provided across the bent section (6). The pressing section (8) holds the flat-type circuit board (1) by elastically pressing it toward a corresponding connecting section (P2) in a state that the flat-type circuit board (1) is between the pressing section (8) and the corresponding connecting section (P2).

7 Claims, 17 Drawing Sheets

ELECTRICAL CONNECTOR FOR CONNECTING A FLAT-TYPE CIRCUIT BOARD

BACKGROUND OF THE INVENTION

1. Field of the Invention

The present invention relates to an electrical connector for connecting a flat-type circuit board to another member to connect, such as another circuit board.

2. Description of the Related Art

For a flat-type circuit board, a flexible printed board (FPC), a flat cable, and so on are known. For an electrical connector to connect the flat-type circuit board to another member, such as another circuit board, for example, a connector disclosed in Japan Patent Application Publication No. 2004-227918 is known.

The connector of the above patent has a pivoting support section at the end of an elastic arm formed on an insulator (housing) to be mounted on a printed circuit board, which is connected to the flat-type circuit board. A lever made of resin is freely rotatably supported at the pivoting support section. A cam section is formed on the lever, and the gap between the cam and the above-described printed circuit board varies depending on the rotational position of the lever. For using such connector, by rotating the lever toward the open position so as to make the above-described gap large, and inserting a flexible circuit board therein, and then reducing the gap by rotating the lever toward the close position, the flexible printed circuit board is pressed onto the printed circuit board, and the circuit boards are electrically connected.

In the connector of the above Patent Reference, however, the lever to press the flexible printed circuit board is formed by molding resin, and is made thick so as to be resistant to rotary movement and to the pressing force. Accordingly, the connector size has to be large for the thickness of the lever. In the connector of this type, it is required to be so-called "low profile" by reducing the size of the connector in the direction vertical to the printed board surface, i.e. in the thickness direction of the lever, when the lever is pressing the printed circuit board. In Patent Reference 1, however, such demand is not satisfied.

In addition, since the above-described lever is made of resin and is not electroconductive, the lever and the flexible printed circuit board contacting with the lever can not be electrically conducted to each other. For this reason, the performances can not be improved to have a shielding performance and grounding performance, for example, by using the surfaces. Such problem is extremely disadvantageous in case of a connector for high-speed transmission.

SUMMARY OF THE INVENTION

In view of the problems described above, an object of the invention is to provide an electrical connector for connecting a flat-type circuit board, which can have low profile design, and is suitable for high-speed transmission.

In the electrical connector for connecting a flat-type circuit board according to the invention, a flat-type circuit board is arranged on a corresponding connecting section of a member to be connected with the circuit board, and is pressed onto the member to be connected using a pressing member.

In the electrical connector for connecting a flat-type circuit board, the invention is featured by a pressing member. The pressing member of the invention has a section to be supported by a support member, which is provided directly or indirectly at the member to be connected to the circuit board, and a flat section and an elastic pressing section, which are provided across a bent section that is formed by bending sheet metal. Once the flat-type circuit board is inserted between the pressing member and the corresponding connecting section, the pressing member elastically presses the flat-type circuit board onto the corresponding connecting section and holds the circuit board.

In this invention, since the pressing member to provide the pressing force to connect with the member to be connected is made by bending sheet metal, there are two effects, reduction of the connector size and ensured shielding. First, since the pressing member includes the flat section and the pressing section that is formed to be substantially parallel to the flat section, the thickness is just slightly larger as a whole than the thickness when two sheet metals are simply overlaid together. Therefore, the size can be reduced while maintaining the strength. Second, since the flat section covers at least a part of the area, where the flat-type circuit board and the member to be connected are connected, the area can be shielded. When used, a contact point of the flat-type circuit board is elastically pressed by the pressing member, and connected to the member to be connected.

In this invention, the pressing member is preferably designed so that the flat section covers area of the member to be connected when it holds the flat-type circuit board. With this design, the whole area covered by the flat section can be shielded.

In this invention, the pressing member preferably has a reinforcing bent section at least at a part of an edge of the flat section. Since the connector often has space for the above-described reinforcing bent section, the strength of the pressing member can be improved without increasing the dimension of the whole connector in the thickness direction. In order to further improve the strength of the pressing member, the reinforcing bent section can be provided at the flat section so as to surround the pressing section.

In this invention, the pressing member can be designed so that the section to be supported is formed at the inner surface of the bent section and the portion to be supported is supported by a latching section provided at the support member, and the pressing member can rotate about the latching section between the holding position and the open position. At the open position, the pressing member makes wide space to allow easy insertion of the flat-type circuit board. At the holding position, the pressing member elastically presses the flat-type circuit board onto the member to be connected via the pressing section having elasticity.

In the invention described above, the pressing member can be formed to have a plurality of parallel elastic sections that extends toward the free end from the bent section or from a portion adjacent to the bent section, and the elastic sections can have the pressing sections. Since a plurality of the elastic sections is provided, each elastic section can be elastically deformed easier than when only one elastic section is provided.

In this invention, the support member is preferably made from metal and the pressing member and the support member are preferably electrically conducted to each other at least when the pressing section presses the circuit board. By making the support member from metal, the support strength can be improved, and the pressing member can be also connected to ground via the support member without using any other member.

In this invention, the support member can have a plurality of windows, and corresponding elastic sections that are put into the windows and an edge of each window supports the base portion of each elastic section, which is the bent section. If the pressing member can rotate, such rotation can be made around the edge of the windows and supported thereby.

The flat section of the pressing member and the support member preferably have a locking section that latches to each other when the pressing section presses. With this structure, the pressing can be more secured.

Instead of the above-described invention, the object of the invention can be attained also by the invention having the following constitution.

According to this invention, in the electrical connector for connecting a flat-type circuit board, in which a pressing member presses a terminal of the connector that is connected to the member to be connected, the pressing member has a portion to be supported by a housing of the connector that is attached to the member to be connected. In addition, the pressing member has a bent section formed by bending sheet metal, and has a flat section and a pressing section that faces the flat section. The pressing member holds the flat-type circuit board in cooperation with an elastic contact section of the terminal while the flat-type circuit board is between the pressing member and the elastic contact section of the terminal.

While the pressing member according to the first aspect of the invention has elasticity and elastically presses the flat-type circuit board toward the member to be connected, the elastic contact section is provided at a terminal of the connector according to the second aspect of the invention. In this invention, the pressing member presses the flat-type circuit board toward the elastic contact section of the terminal to be contacted with the member to be connected so as to make elastic contact. Therefore, the pressing member itself does not necessarily have to have elasticity.

Even in the second aspect of the invention, with similar reason to the first aspect of the invention, the connector size can be reduced and the connecting area of the flat-type circuit board can be securely shielded. According to the second aspect of the invention, the pressing member is preferably designed to cover the area of the member to be connected by the flat section when the flat-type circuit board is held by the pressing member. With this design, the whole area can be shielded.

In this invention, the pressing member is preferably designed to have a reinforcing bent section at least at a part of an edge of the flat section when it holds the flat-type circuit board. Since the connector often has space for the reinforcing bent section, the strength of the pressing member can be improved without increasing the dimension of the connector as a whole in the thickness direction. Furthermore, in order to improve the strength of the pressing member, the reinforcing bent section is provided at the flat section so as to surround the pressing sections.

In this invention, the pressing member can have a portion to be supported by the housing at the edge of the flat section at the opposite side to the bent section. Also, in this invention, the pressing member can have a attaching section, which is supported by the housing, at an edge of the flat section in opposite side to the bent section.

As described above, in the present invention, the pressing member, which presses the flat-type circuit board to the member to be connected, has the flat section and the pressing section, which are formed by bending a metallic piece so as to make the two surfaces substantially parallel to each other. The pressing section is positioned so as to face the flat-type circuit board and presses the flat-type circuit board. Therefore, while the strength of the pressing member is fully maintained, the dimension of the whole connector in the thickness direction can be reduced, and therefore, the connector size can be reduced. In addition, since the pressing member is made of metal and has electroconductivity, the area of connecting section of the circuit board can be satisfactorily shielded, and the surface pressed by the pressing member, which is opposite to the signal circuit surface of the flat circuit board, can be connected to ground by contacting with the pressing member, and therefore, the performance of the connector can be improved.

BRIEF DESCRIPTION OF THE DRAWINGS

FIG. 10(A) is a sectional view of FIG. 10(B) taken along line XA-XA. FIG. 10(B) is a sectional view of FIG. 10(A) taken along line XB-XB.

FIG. 11(A) is a sectional view of FIG. 11(B) taken along line XA-XA. FIG. 11(B) is a sectional view of FIG. 11(A) taken along line XB-XB.

FIG. 14(A) is a sectional view. FIG. 14(B) is a side view of FIG. 14(A).

DESCRIPTION OF THE PREFERRED EMBODIMENTS

Figure 1:
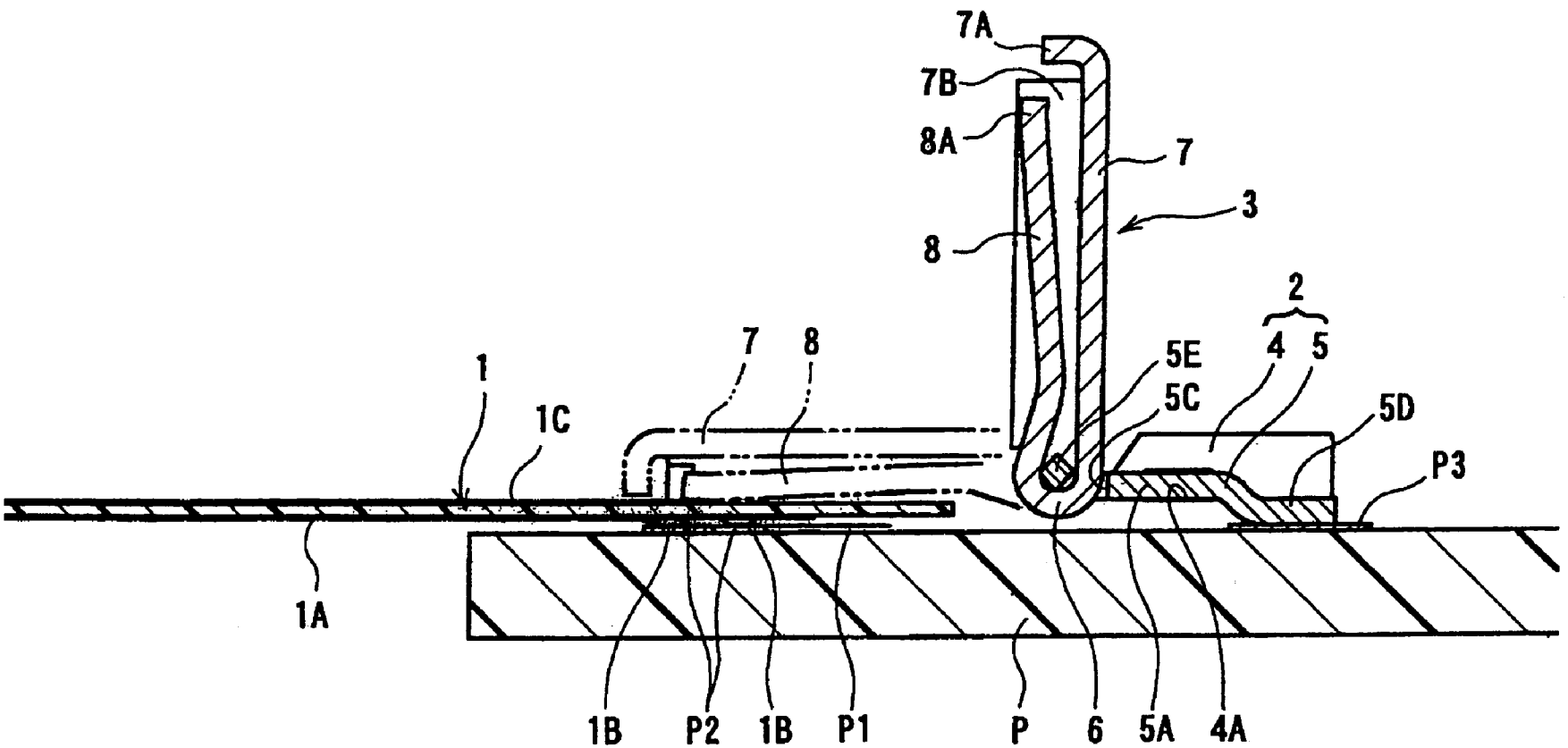
FIG. 1 is a sectional view of a connector according to the first embodiment of the invention.

Hereunder, embodiments of the present invention will be explained with reference to the accompanying drawings.

First Embodiment

An electrically connector of the first embodiment, which is shown in FIGS. 1-5, has a support member 2 to attach the connector to a circuit board P, which is a member to be connected to the flat-type circuit board 1, and a pressing member 3 to press the flat-type circuit board 1 to the circuit board P.

A group of wiring patterns P1, connecting pads 2, which are formed at each end of the wiring patterns P1 and arranged in stagger, and attachment sections P3 to attach the above connector to the circuit board P are provided on the upper surface of the circuit board P. The attachment section P3 is respectively provided at the both sides of the group of wiring patterns P1 and also provided between respective wiring patterns P1.

The support member 2 of the connector is made from sheet metal, and has side members 4 to be attached on the attachment sections formed at the both sides of the group of the wiring patterns P1, and has a joint member to joint the both side members 4.

Figure 2:
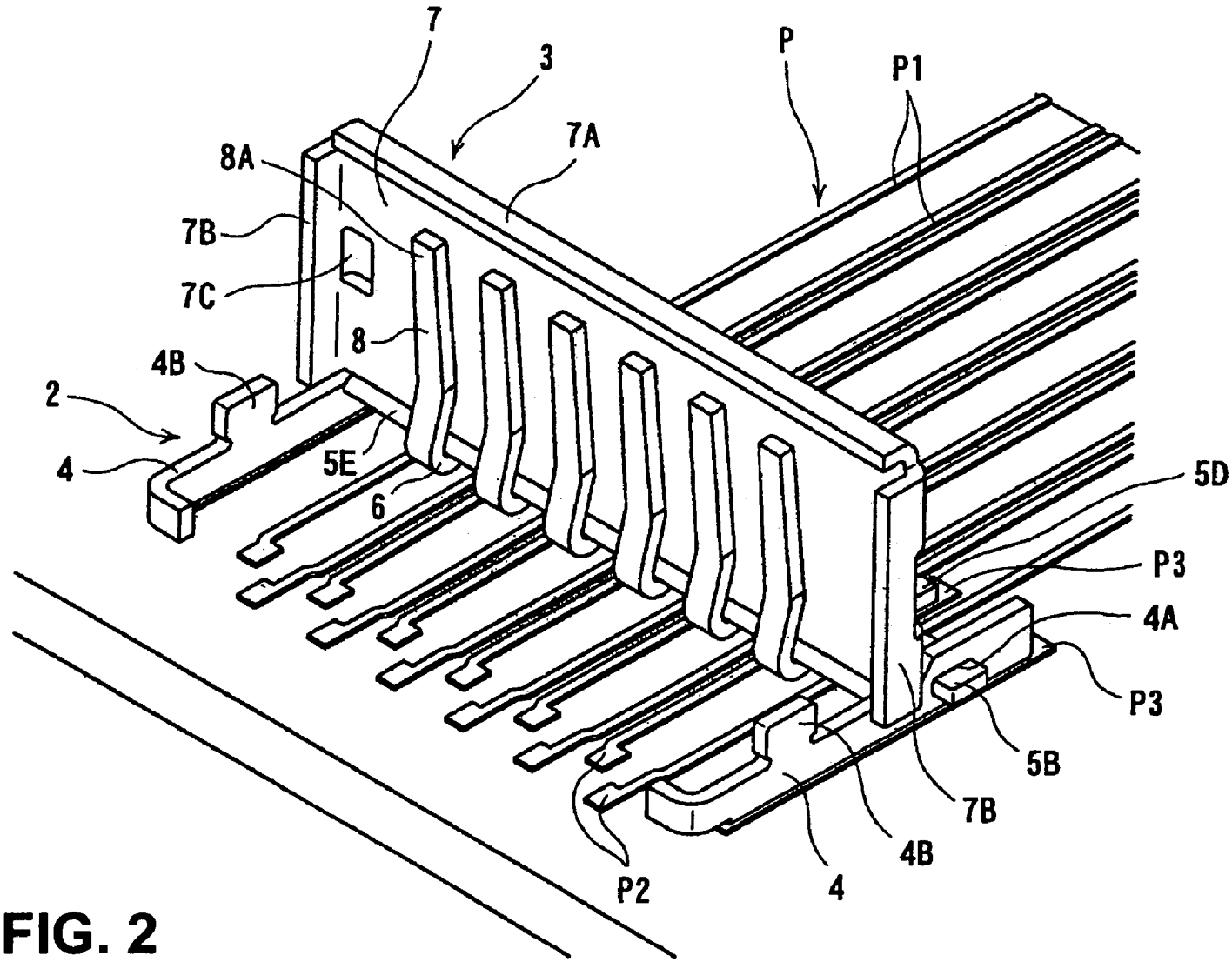
FIG. 2 is a perspective of the connector of FIG. 1 viewed from the front side in a state that a pressing member is at the open position.
Figure 3:
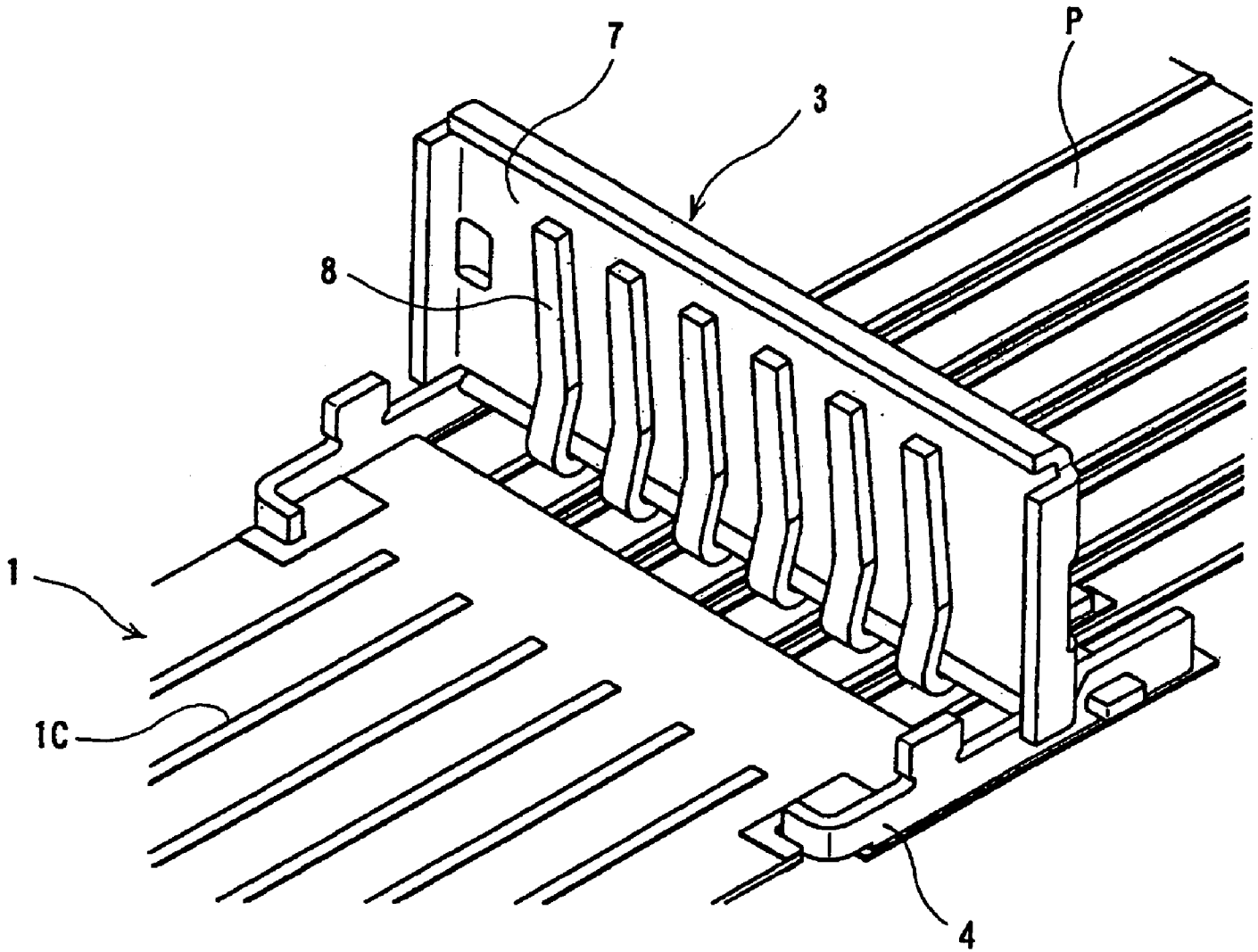
FIG. 3 is a perspective view of the connector of FIG. 2 viewed from the front side in a state that a flat-type circuit board is disposed thereon.
Figure 4:
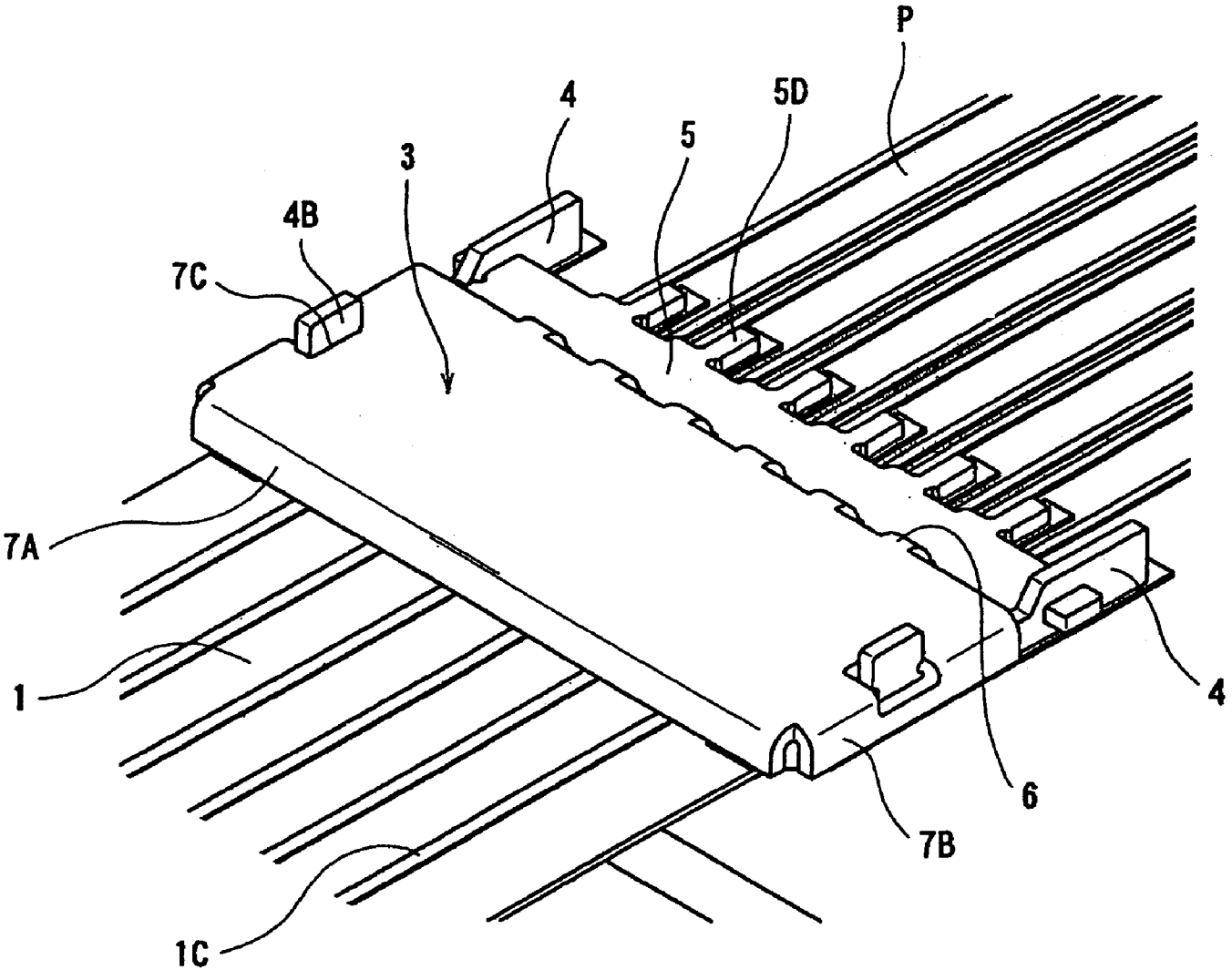
FIG. 4 is a perspective view of the connector of FIG. 2 viewed from the front side in a state that the pressing member is at the holding position.

As can be understood from FIGS. 2-4, each side member 4 is straight and long, and is formed like a thin sheet, the front end (left side in the figures) of which is bent toward the connecting pads P2, and the bottom surface of the straight portion is attached to the attachment section P3 of the circuit board P by soldering. The height dimension of each side member 4 is larger at the rear end, where a hole 4A is formed. The joint member is jointed to the side members 4 by pressing edges of the joint member 5 to the holes 4A. In addition, a locking section 4B is provided, protruding from the upper edge of each side member 4.

The joint member 5 has a flat section 5A, press-in protrusions 5B to be pressed in the holes 4A, which protrude from the both side edges of the flat section 5A, a plurality of windows 5C formed near the front edge of the flat section 5A, and plurality of attaching sections 5D, which protrude backward and downward from the rear edge of the flat section 5A and then become horizontal again. The windows 5C and the attaching sections 5D are respectively provided between the respective wiring patterns in the direction of arrangement of the wiring patterns P1, i.e. in the direction that connects the side members 4. The front edge of the flat section 5A, which forms the edges of the windows 5C, is slightly bent upward, and provides a pivot-like rotation support section 5E for rotational movement of the pressing member 3.

Figure 5:
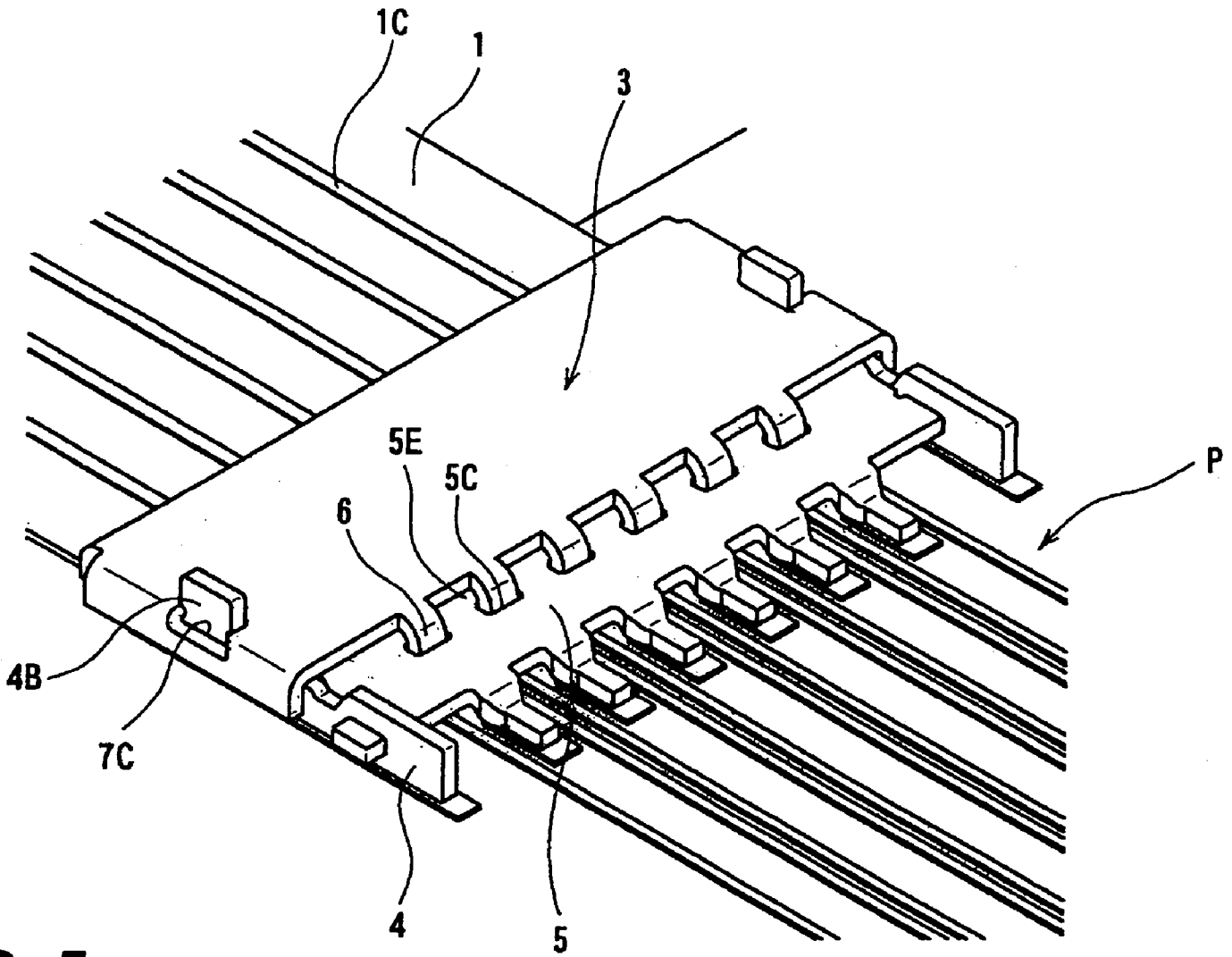
FIG. 5 is a perspective view of the connector of FIG. 2 viewed from the back side in a state that the pressing member is t the holding position.

The pressing member 3, which is supported by the support member 2 so as to be freely rotatable, is made by bending sheet metal so as to have the two surfaces parallel to each other, and have the flat section 7 and the pressing section 8 across the bent section 6. The pressing member 3 can rotate between the open position, in which it is vertically positioned as illustrated in FIGS. 1-3, and the holding position, in which it is horizontally positioned as illustrated in FIGS. 4 and 5. The pressing member 3 has a shape and size, so that the flat section 7 can fully cover the area between the both side members, i.e. the area where the connecting pads P2 of the plurality of wiring patterns P1 are provided. The pressing member 3 has bent sections for reinforcing the flat section 7, which are formed by bending the front edge 7A and the side edges 7B. The bent sections on the both side edges 7B respectively have a locking window 7C. The locking section 4B formed on each side member 4 of the support member 2 is designed to be fitted and locked in the locking window 7C at the edge so as to be releasable therefrom.

The bent sections 6 and the pressing sections 8 of the pressing member 3 are formed respectively at a plurality of arms that respectively extend from the rear edge of the flat section 7. In other words, each arm has one bent section 6 and one pressing section 8, which continuously extends from the bent section 6 being substantially horizontal to the flat section 7. Accordingly, a plurality of bent sections 6 extend from the flat section 7, and the pressing section 8 is continuously formed from each bent section 8. Each pressing section 8 thinly extends being away from the flat section 7 so as to make space therebetween, and forms an elastic section, which can elastically deform in the direction perpendicular to the sheet surface of the flat section 7. The free end of each pressing section 8 extends close to the front edge of the flat section 7. Each pressing member 3 is designed to be putted to the support member 2 by putting the rotation support section, which is the front end of the window 5C formed on the joint member 5 of the support member 2, into the space between the free end 8A and the front edge 7A. After putting the pressing members into the space, the rotation support section 5E of the support member 2 is positioned so as to contact with the inner surface of the bent section 6 of the pressing member 8. The pressing member 8 is supported therein, being freely rotatable. Accordingly, the bent section 6 is formed as a section to be supported at the time of rotational movement of the pressing member 3.

In the connector of this embodiment composed as described above, the flat-type circuit board is connected as described below.

(1) First, as shown in FIG. 2, the pressing member 3 is placed at the open position, where it vertically stands, and the connecting pads P2 on the circuit board P are exposed.

(2) Thereafter, the flat-type circuit board is placed on the connecting pads P2 (See FIGS. 1 and 3). In this embodiment, the flat-type circuit board 1 has a plurality of signal circuits 1A and contact points 1B near the ends of the signal circuits 1A on its lower surface of the insulting sheet. Furthermore, ground circuits 1C are formed at suitable intervals on the upper surface of the flat-type circuit board 1. As well illustrated in FIG. 6, the flat-type circuit board of FIG. 3 has a plurality of signal circuits 1A, which have contact points in stagger, on one of the surfaces. Among the plurality of signal circuits 1A, the signal circuits 1A arranged on the both sides are formed as independent signal lines, and the adjacent signal circuits 1A arranged between the independent signal circuits on the sides form a signal line pair. The ground circuits (lines) 1C on the other surface are arranged between the respective signal line pairs. Here, the both side edges of the flat circuit board 1 have the reinforcing section 1D, and a latching groove 1E is formed on each reinforcing section 1D. By latching the front end bent sections of the side members 4 of the support member 2 in the latching grooves 1E, the flat-type circuit board is prevented from coming off.

(3) Then, as shown by long dashed double-dotted lines in FIG. 1, and in FIGS. 4 and 5, the pressing member 3 rotationally moves to the holding position, where the pressing member 3 is horizontally positioned. Once the pressing member 3 rotationally moves to the specified position, the edges of the locking windows 7C engage with the narrowed sections of the locking sections 4B of the support member, and the pressing member 3 is locked therein the position. Accordingly, the flat-type circuit board 1 is connected to the connecting pads P2 of the wiring patterns P of the circuit board P via the contact points 1B, and the ground circuits 1C are connected to ground at the attachment section P3 of the circuit board P via the pressing section 8 and the rotation support section 5E of the joint member 5, which contacts with the pressing section 8. Then, the contact points 1B are fully shielded by the flat section 7 that covers the contact points 1B, and connected to ground via the rotation support section 5E.

Figure 6:
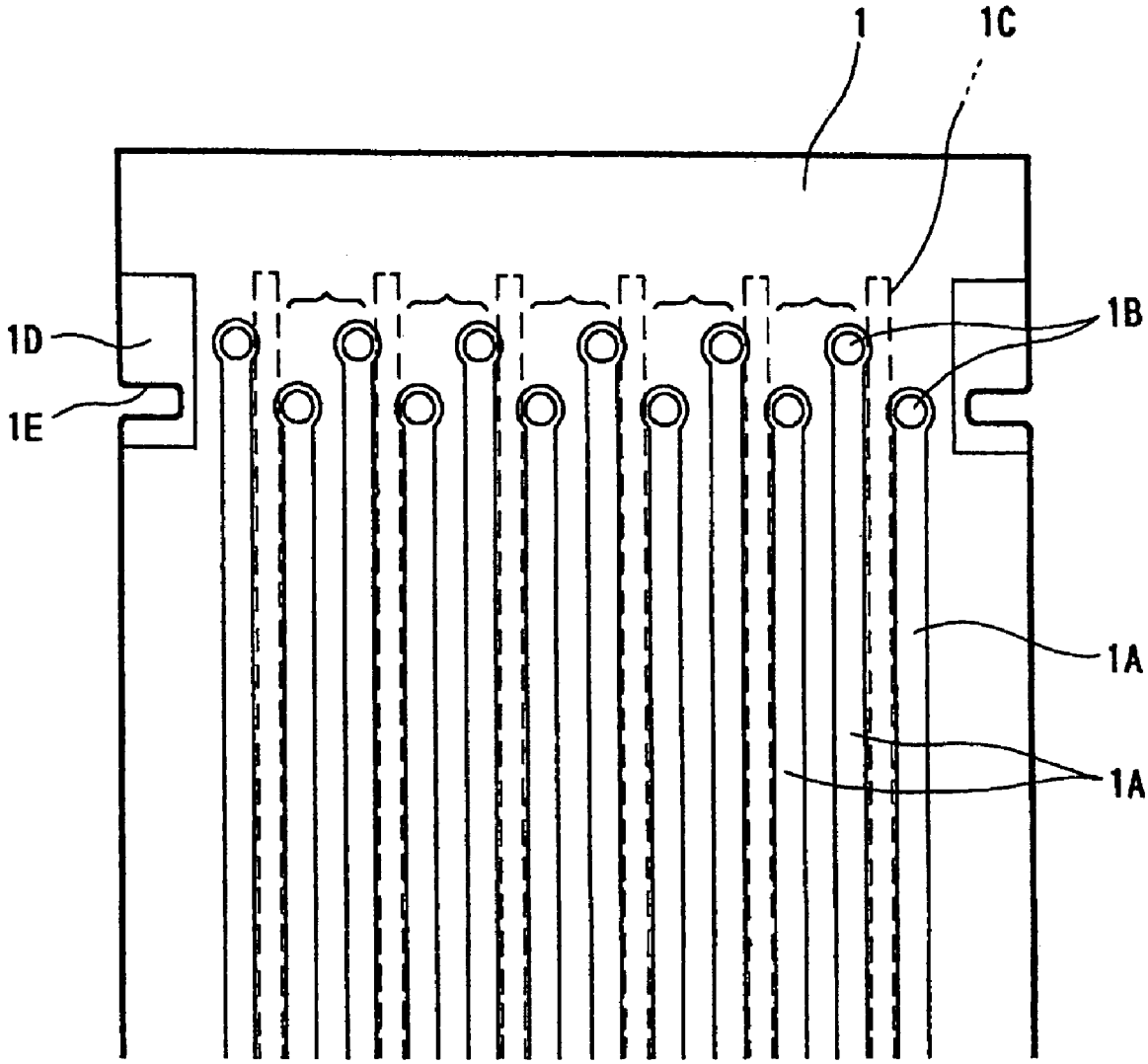
FIG. 6 shows an example of the flat-type circuit board used in the connector of FIG. 1.
Figure 7:
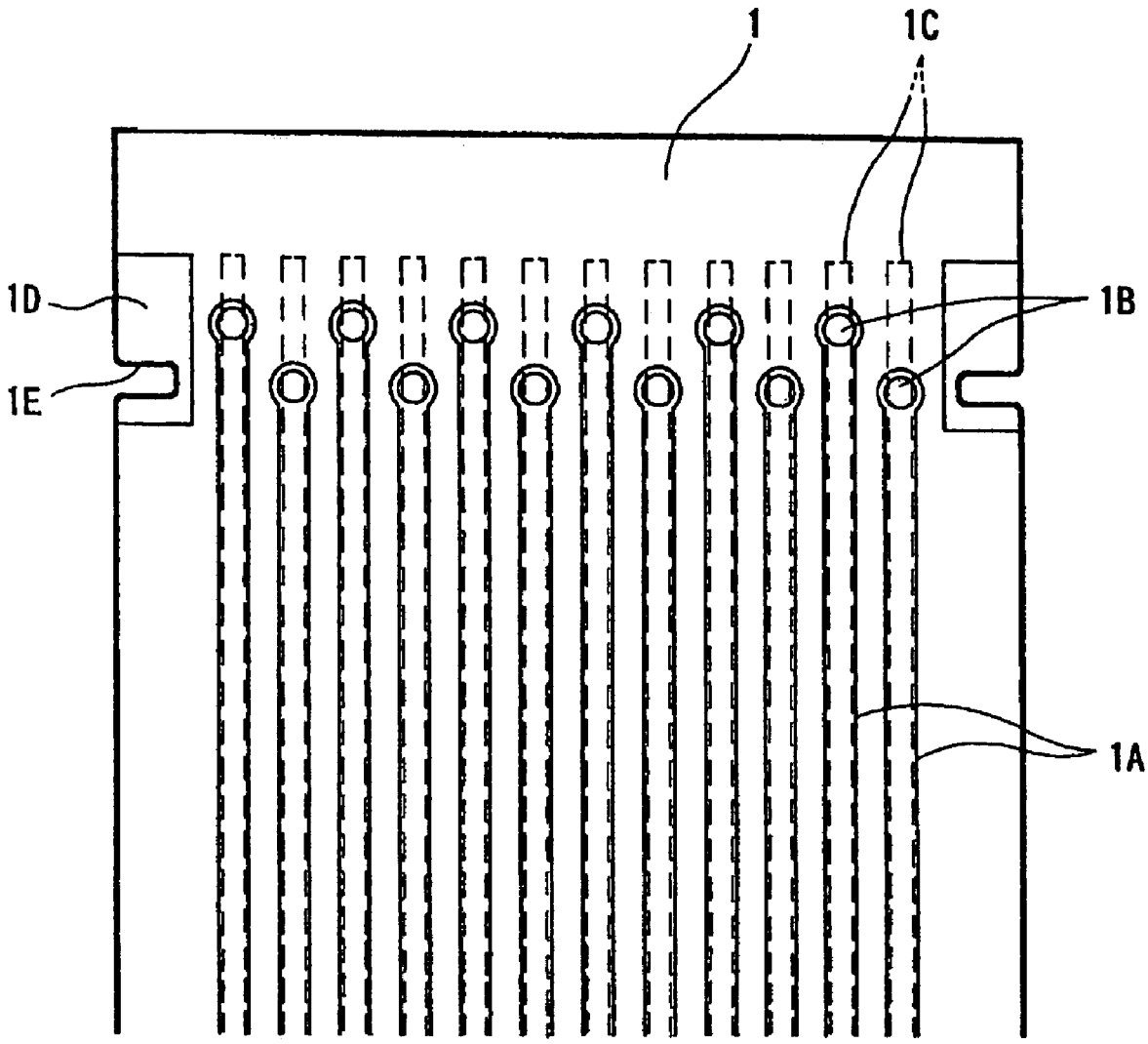
FIG. 7 shows another example of the flat-type circuit board used in the connector of FIG. 1.
Figure 8:
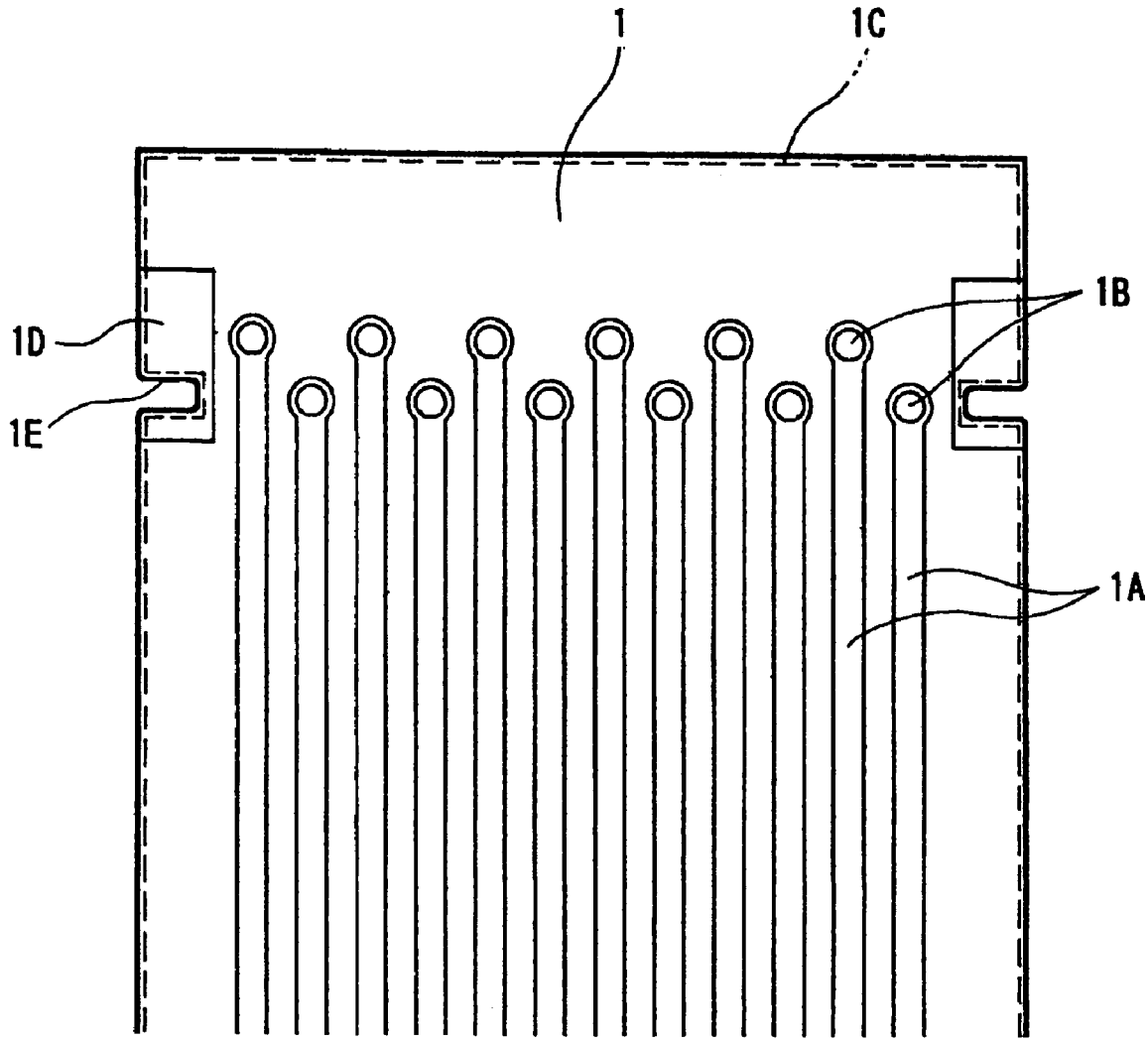
FIG. 8 is still another example of the flat-type circuit board used in the connector of FIG. 1.

In this embodiment, the ground circuits 1C are not limited to the ones in the embodiment of FIG. 6. For example, as shown in FIG. 7, a plurality of signal circuit 1A formed on one of the surfaces is used as independent signal lines, and the ground circuits 1C can be provided on the other surface corresponding to the respective signal circuits 1A. Alternatively, as shown in FIG. 8, the ground circuit 1C can be formed on the whole area of the other surface.

Second Embodiment

Figure 9:
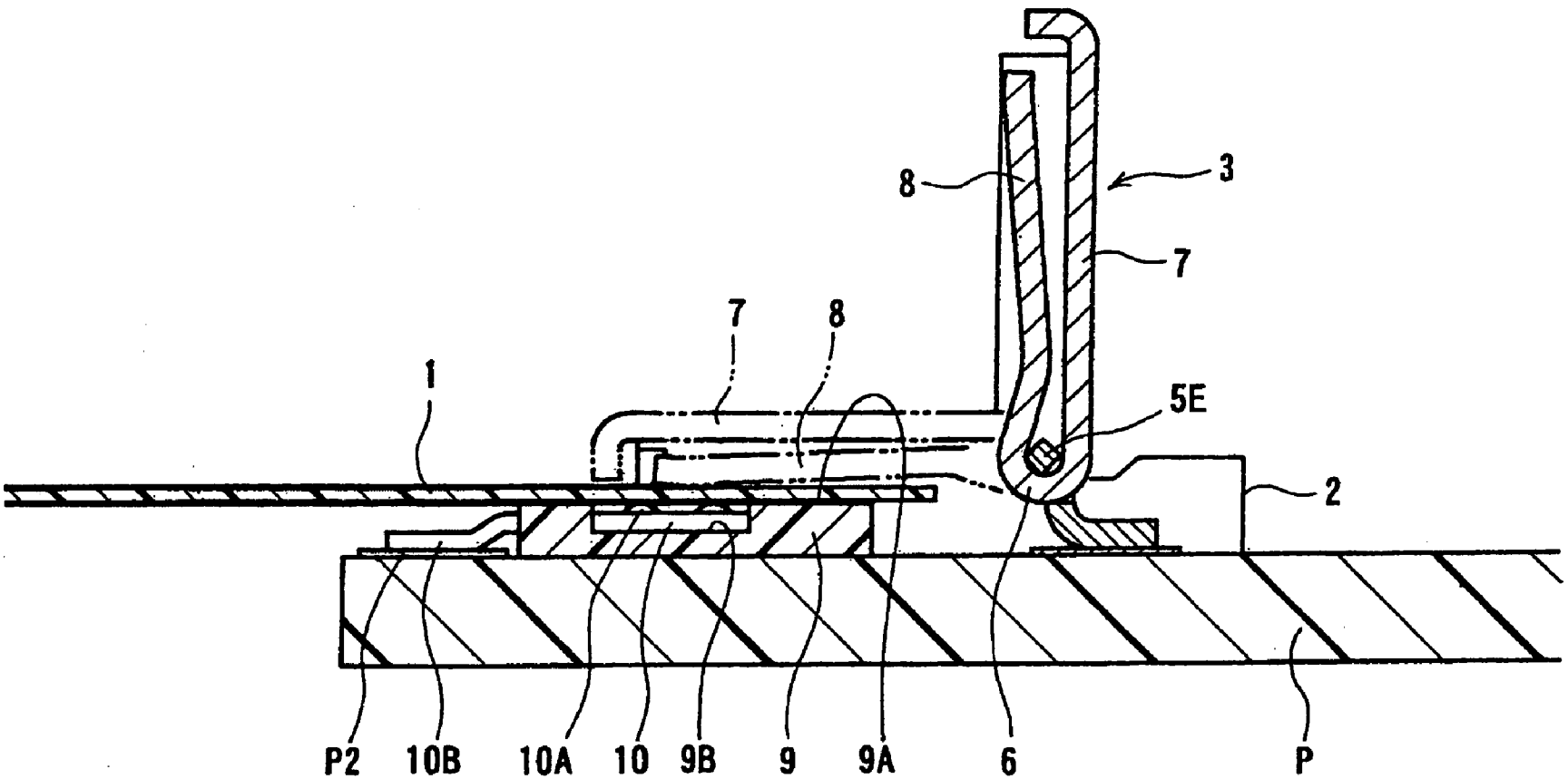
FIG. 9 is a sectional view of a connector according to the second embodiment of the invention.

While the flat-type circuit board 1 is connected the circuit board P by directly contacting thereto in the first embodiment, it is connected to the circuit board P via terminals provided at the connector in the embodiment illustrated in FIG. 9.

In this embodiment, the connector has an insulated housing 9, which is supported by the support member 2, and the terminals 9 are supported by the housing 9. In case of the connector of the figure, a recess 9B is formed in the center of the flat section 9A formed on the upper surface of the housing 9, and a contact point 10A provided at one end of the terminal 10 is arranged in the recess 9B being slightly above the flat section 9A. The other end of the terminal 1 protrudes outside of the housing 9 and bent, and forms the connecting section 10B to be connected to the circuit board P by soldering.

In this embodiment described above, by positioning the pressing member at the open position, the flat circuit board 1 is arranged on the flat section 9A of the housing 9. Then, by rotationally moving the pressing member 3 to the holding position indicated with a long dashed double-dotted line, the flat-type circuit board 1 is connected to the circuit board P via the terminal 10. Simultaneously, the connected area of the flat-type circuit board is shielded and connected to ground by the flat section 7.

Third Embodiment

Figure 10:
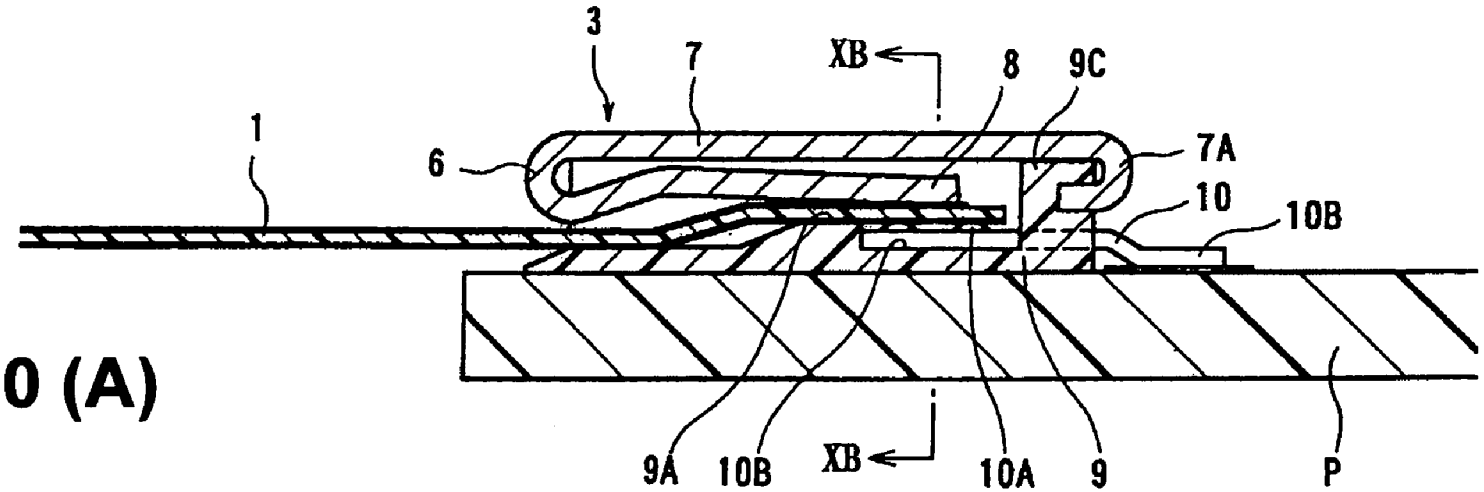
FIGS. 10(A) and 10(B) are sectional views of a connector according to the third embodiment of the invention.
Figure 10:
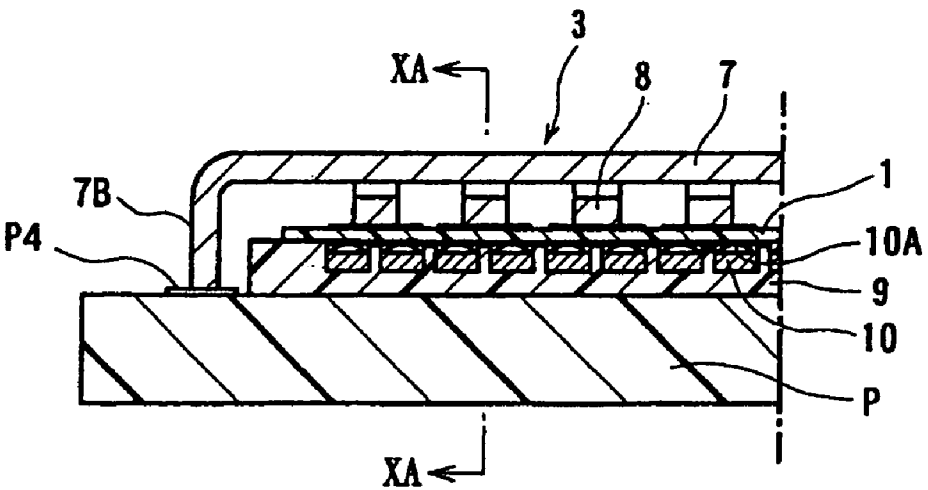

In the first and the second embodiments, the pressing member rotationally moves. In this embodiment illustrated in FIG. 10, the pressing member stays at a stationary position and does not rotate. FIG. 10(A) shows the cross section of FIG. 10(B) taken along line XA-XA. FIG. 10(B) shows the cross section of FIG. 10(A) taken along line XB-XB.

In this embodiment, a part of the housing to hold the terminal 10 also has a function of a support member. A portion of the housing 9, which holds the terminals 10, protrudes upward and forms the support section 9C.

The front edge 7A of the flat section 7 of the pressing member 3 is bent into a U-shape and forms a portion to be supported. By forming the front edge 7A and the support section 9C as a one-piece component, or by pressing the front edge 7A into the groove formed at the support section, the pressing member 3 is supported by the support section 9C.

The housing 9 has a flat section similar to the one in the second embodiment. The contact points 10A of the terminals 10 are arranged in the recesses 9B formed adjacent to the flat section 9A. The upper surface of the housing also has a tapered section and a low-height section that is continuously formed from the tapered section, and forms space to insert the flat-type circuit board between the bent section 6 of the pressing member 3 and the housing 9.

Since the pressing member 3 is a stationary member and does not rotate, it can be supported by soldering to the circuit board P at the side edges 7B (See the soldered section P4 in FIG. 10(B)), instead of supporting the pressing member 3 by the support section 9C at the front edge 7A.

In this embodiment, the flat-type circuit board 1 is inserted in the space between the housing 9 and the bent section 6 of the pressing member 3 from the left side in FIG. 10. Once it is inserted to the specified position, the flat-type circuit board 1 is pushed to the contact points 10A of the terminals 10 by elastic force from a plurality of pressing sections 8 of the pressing member 3, and connected to the circuit board P via the terminals 10, and also shielded and connected to ground by the flat section 7.

Fourth Embodiment

Figure 11:
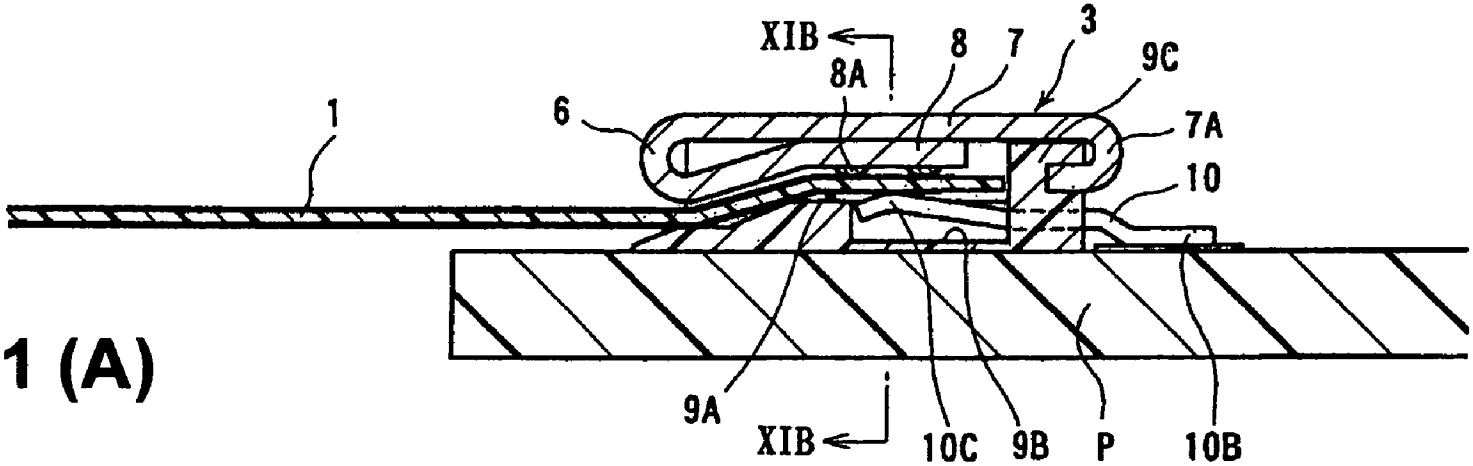
FIGS. 11(A) and 11(B) are sectional views of a connector according to the third embodiment of the invention.
Figure 11:
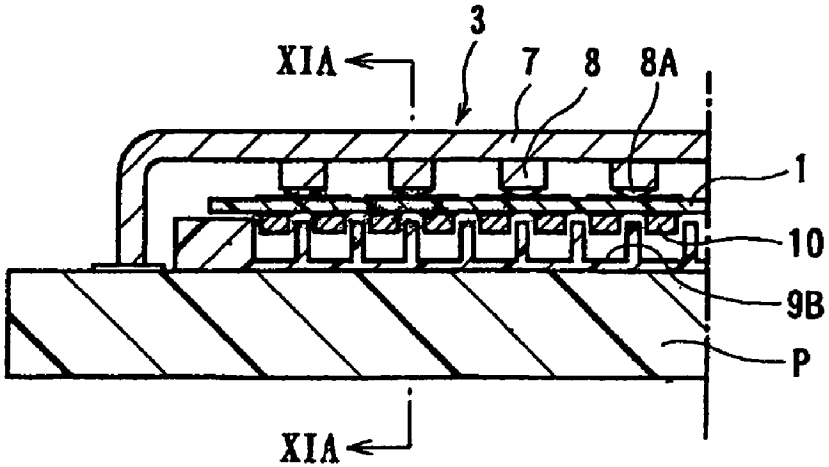

While the pressing section of the pressing member has elasticity in the third embodiment, the pressing section does not have elasticity in the fourth embodiment illustrated in FIG. 11. Being different from the third embodiment, the terminals, which are held by the housing, have elasticity in this embodiment. FIG. 11(A) shows the cross section of FIG. 11(B) taken along line XIA-XIA, and FIG. 11(B) shows the cross section of FIG. 11(A) taken along line XIB-XIB.

In this embodiment, the pressing section 8 of the pressing member 3 is tightly placed on the flat section 7 and does not elastically deform. On the other hand, the recesses 9B of the housing 9 are relatively deep, and the contact sections 10C of the terminals 10 held by the housing 9 have elasticity, so that the recesses 9B allow the elastic deformation of the contact sections 10C. The contact sections 10C are slightly bent and protrude upward than the flat section 9A of the housing 9.

In this embodiment, once the flat-type circuit board 1 is inserted from the left side in FIG. 11, it is tightly held at a specified position by elastic pressure between the contact sections 10C of the terminals 10, which has elasticity, and the contact points 8A of the pressing section 8. Accordingly, the flat-type circuit board 1 is connected to the circuit board P, and simultaneously shielded and connected to ground by the flat section 7.

Fifth Embodiment

Figure 12:
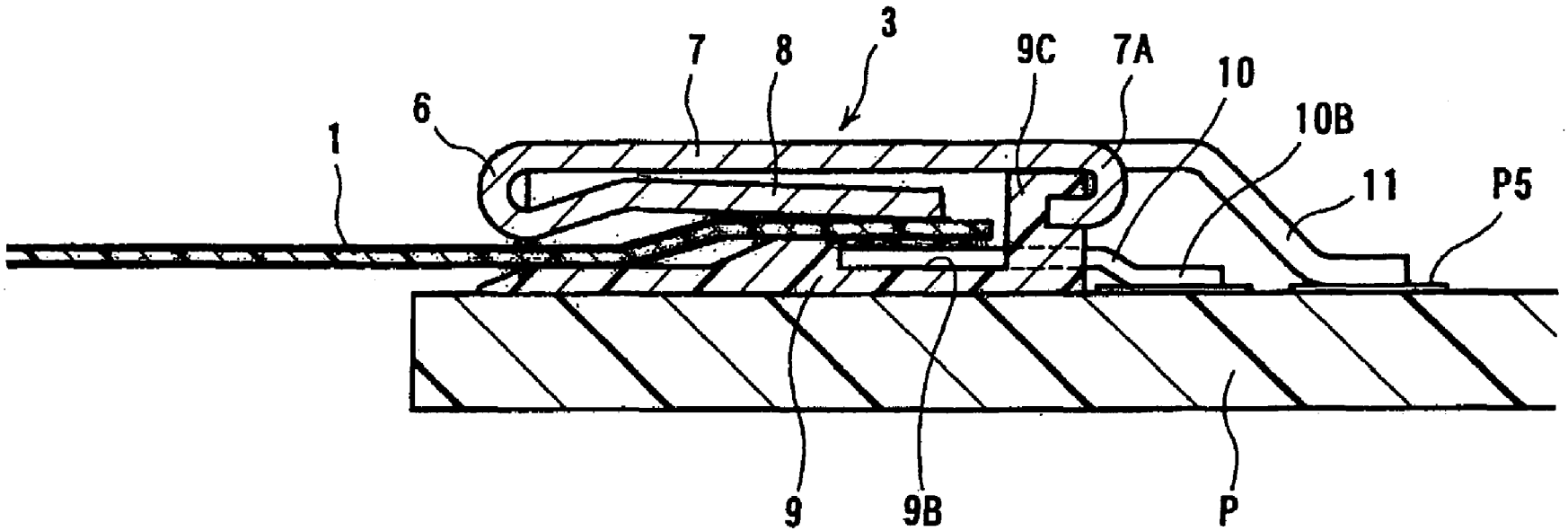
FIG. 12 is a sectional view of a connector according to the fifth embodiment.

The fifth embodiment illustrated in FIG. 12 is similar to the third embodiment of FIG. 10, but differs from the third embodiment in that the pressing member 3 has an attaching section 11 that is attached to the circuit board P. This attaching section 11 is formed by extending forward specifically from the front edge of the flat section 7 and bending toward the circuit board P, and then soldered at the soldering section P5. This attaching section extends from the front edge of the flat section 7 so as to be outside the area of the terminal arrangement in the direction of the terminal arrangement. By soldering the attaching section 11 to the attachment section P5, the connector is securely attached.

Sixth Embodiment

Figure 13:
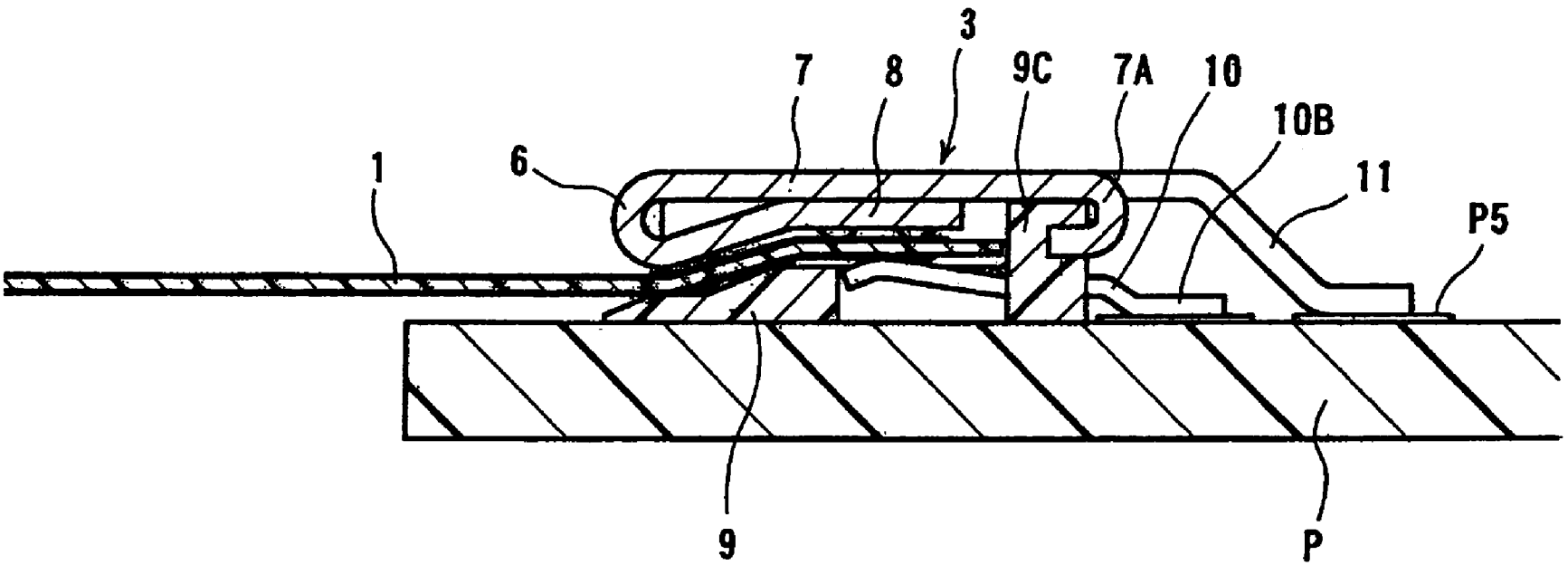
FIG. 13 is a sectional view of a connector according to the sixth embodiment.

The sixth embodiment illustrated in FIG. 13 is featured by having the pressing member 8 and the terminal 10 in the fourth embodiment illustrated in FIG. 11 and by having the attaching section 11 of the fifth embodiment illustrated in FIG. 12.

Seventh Embodiment

Figure 14:
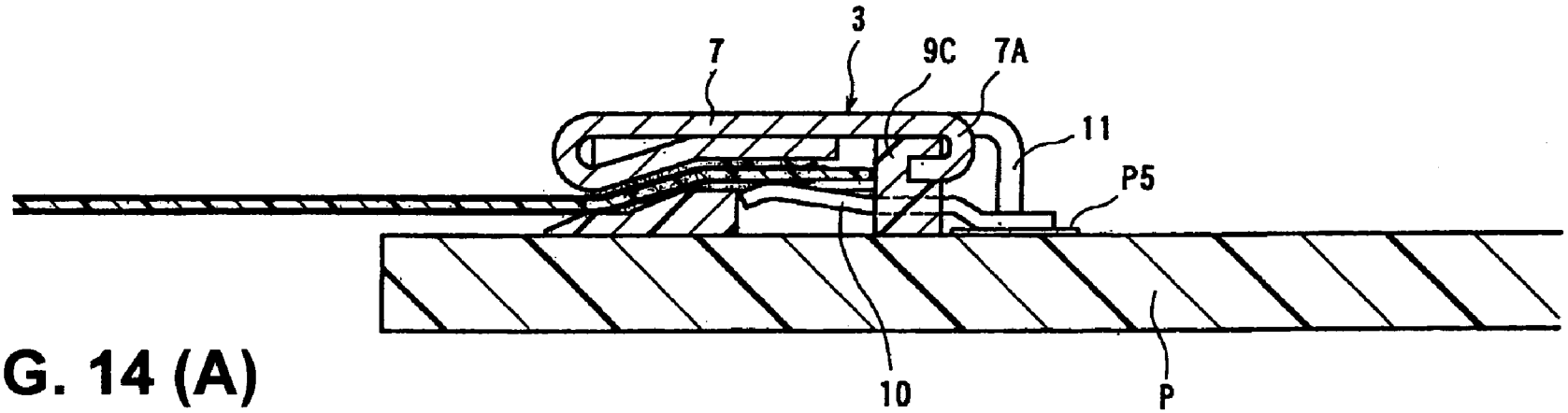
FIGS. 14(A) and 14(B) show a connector according to the seventh embodiment.
Figure 14:
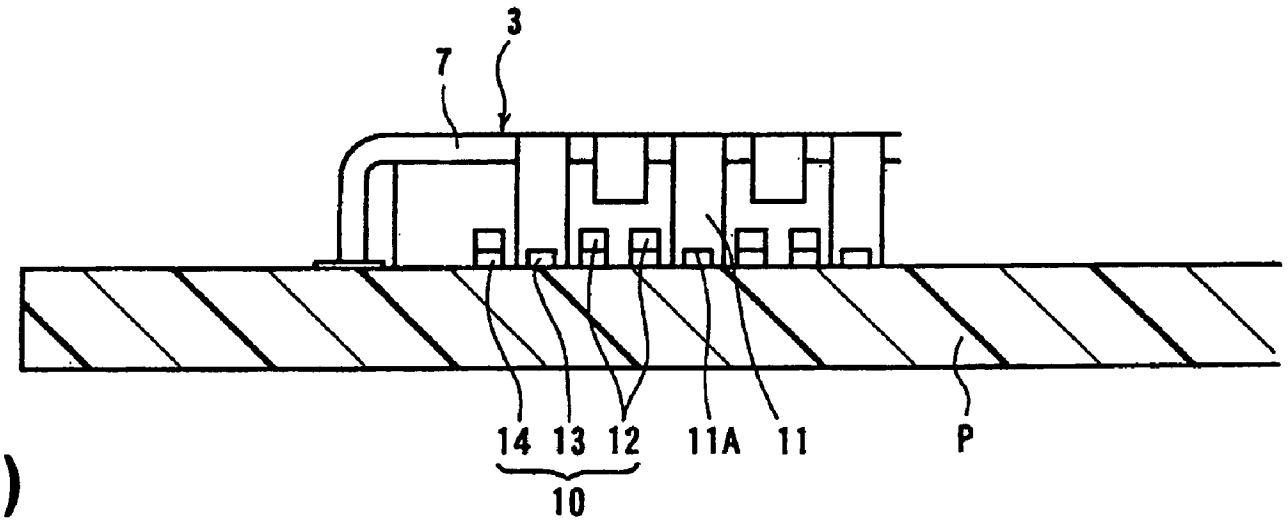

The seventh embodiment illustrated in FIG. 14 is featured by changing the shape and the position of the attaching section 11 of the sixth embodiment illustrated in FIG. 13. FIG. 14(A) is a sectional view and FIG. 14(B) is a side view of the connector viewed from the right side.

As illustrated in FIG. 14(B), all of the plurality of terminals is not used for signal terminal. For example, it can have an independent signal terminal on the both sides and have a plurality of signal terminal pairs 12 between the independent signal terminals 14, and terminals arranged on the both sides of the signal terminal pairs 12 are used as the ground terminals 13. Each attaching section 11 has a groove 11A that is formed so as to cover the ground terminal 13 when it is attached to the circuit board P. The ground terminals 13 are also secured by soldering in the grooves by the attaching section that is attached to the soldering section P5 of the circuit board P. With this design, the connector is even more strongly attached thereto.

Figure 15:
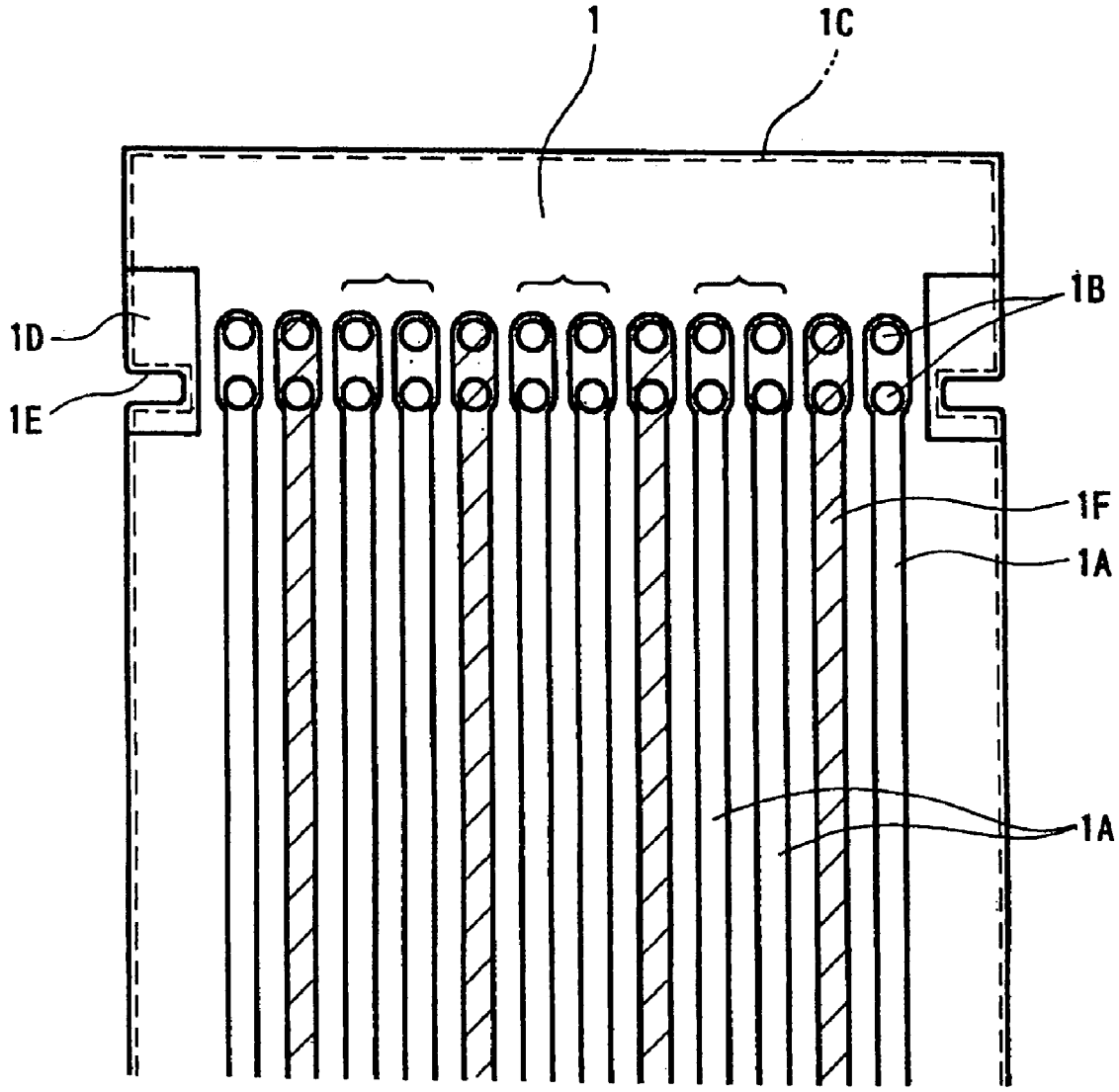
FIG. 15 shows another example of the flat-type circuit board used in this invention.

As shown in FIG. 15, the flat-type circuit board 1 used in this case has the independent single circuit 1A on the both sides in the circuit arrangement direction and signal circuit pairs 1A and ground circuits 1F between the independent signal circuits on one surface, and ground circuit 1C on the whole area of the other surface.

Figure 16:
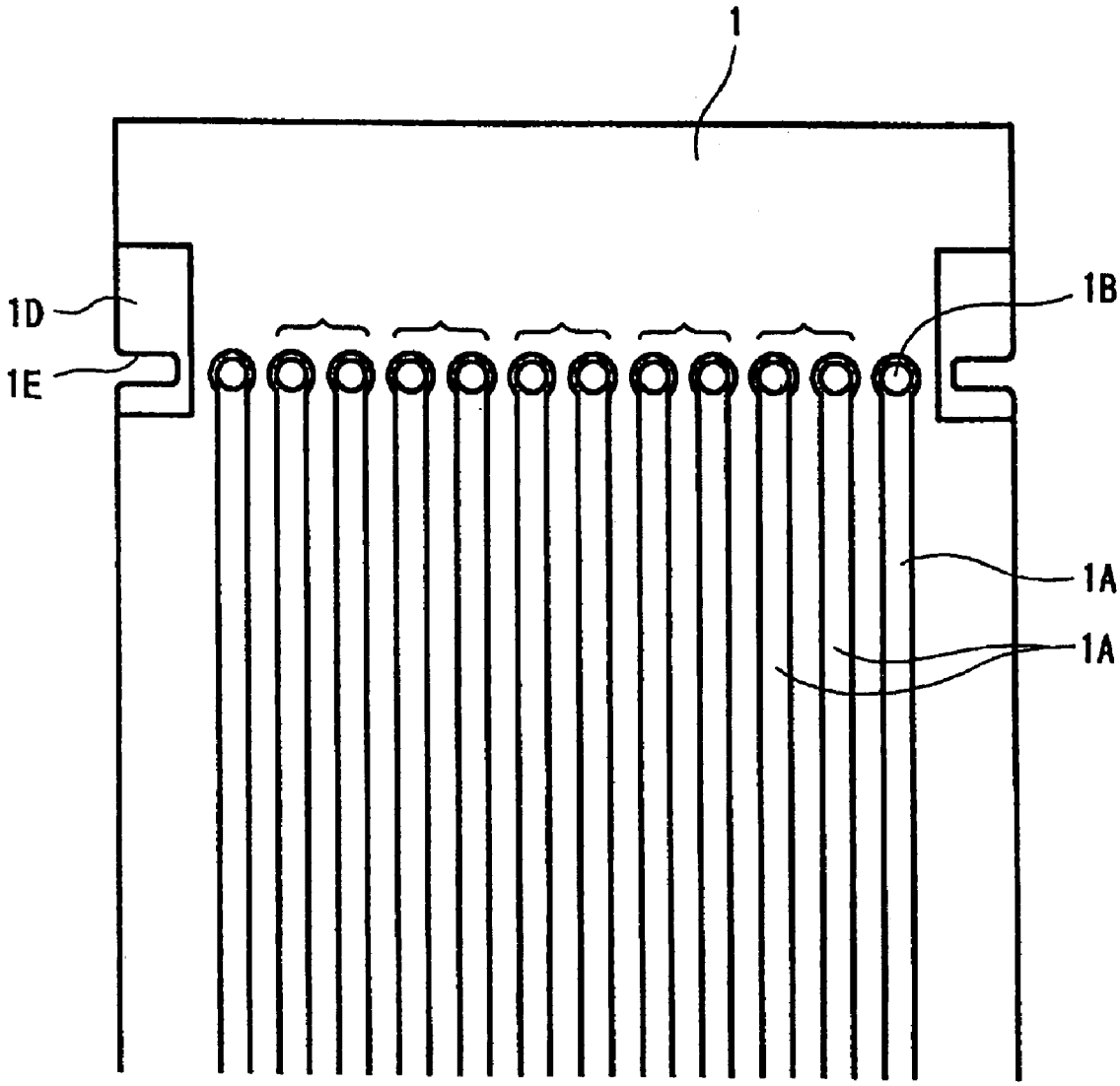
FIG. 16 shows still another example of the flat-type circuit board used in this invention.
Figure 17:
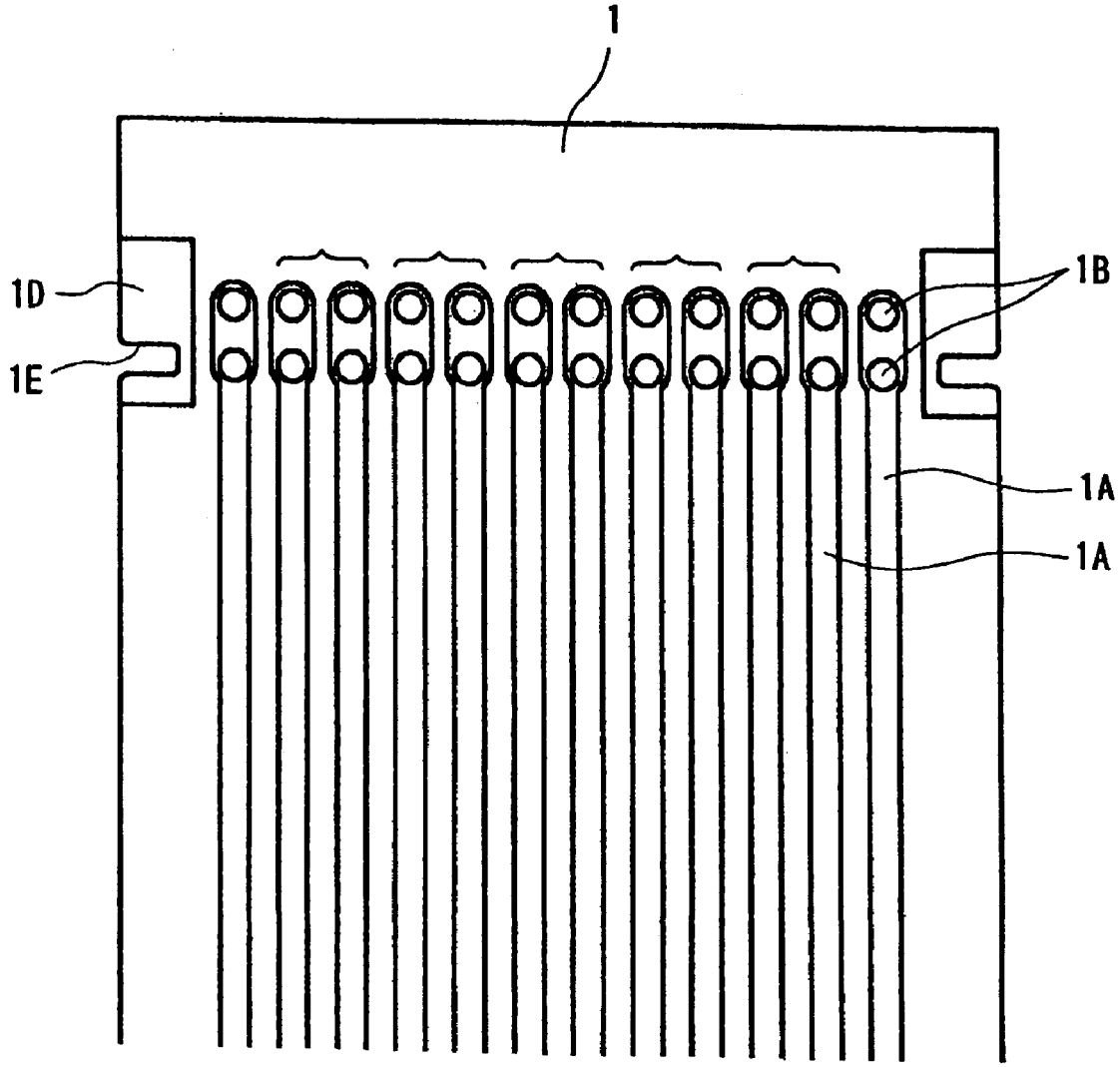
FIG. 17 shows a further example of the flat-type circuit board used in this invention.

In this invention, in either of the first embodiment or the second embodiment, the contact points 1B of the flat-type circuit board 1 may not be arranged in stagger, but can be simply arranged in a straight line as in FIG. 16 or 17. At this time, one contact point 1B can be provided per one circuit, or two contact points 1B can be provided as in FIG. 17. In either case, the corresponding connecting pads of the circuit board P are formed corresponding to the number of the contact points 1B.

What is claimed is:

1. An electrical connector for connecting a flat-type circuit board, comprising a pressing member to press said flat-type circuit board to a member to be connected after said flat-type circuit board is arranged on a corresponding connecting section of said member to be connected, wherein said pressing member comprises:

a section to be supported by a support member that is directly or indirectly provided on said member to be connected;

a bent section, which is formed by bending sheet metal;

a flat section;

a reinforcing bent section at least at a part of an edge of said flat section; and a pressing section having elasticity and facing said flat section, wherein said reinforcing bent section is provided on said flat section so as to surround said pressing section, said flat section and said pressing section are provided across said bent section, and said pressing section holds said flat-type circuit board by elastically pressing the flat-type circuit board toward said corresponding connecting section in a state that said flat-type circuit board is between said pressing section and said corresponding connecting section.

2. The electrical connector for connecting a flat-type circuit board according to claim 1, wherein said pressing member is formed so that said flat section covers an area of said member to be connected in a state that said flat-type circuit board is being held.

3. The electrical connector for connecting a flat-type circuit board according to claim 1, wherein said pressing member forms a section to be supported on a bent inner surface of said bent section, said support member has a latching section, and said pressing member can rotate around said latching section between a holding position and an open position, while said section to be supported is supported by said latching section.

4. The electrical connector for connecting a flat-type circuit board according to claim 1, wherein said pressing member has a plurality of elastic sections, which are parallel to each other and extend from or near from said bent section toward a free end thereof, and said elastic sections form said pressing section.

5. The electrical connector for connecting a flat-type circuit board according to claim 1, wherein said support member is made of metal and is electrically conducted to said pressing member at least in a state that said pressing section presses said flat-type circuit board.

6. The electrical connector for connecting a flat-type circuit board according to claim 4, wherein said support member has a plurality of windows for passing the elastic sections therethrough, each of said windows having an edge portion for supporting a base portion of each of the elastic sections.

7. The electrical connector for connecting a flat-type circuit board according to claim 2, wherein said pressing member forms a section to be supported on a bent inner surface of said bent section, said support member has a latching section, and said pressing member can rotate around said latching section between a holding position and an open position, while said section to be supported is supported by said latching section.

* * * * *